US009878728B2

(12) United States Patent
Stroud

(10) Patent No.: US 9,878,728 B2
(45) Date of Patent: Jan. 30, 2018

(54) COUPLER

(71) Applicant: T A Savery & Co., Ltd., Coventry (GB)

(72) Inventor: Edward Stroud, Lighthorne (GB)

(73) Assignee: T A Savery & Co., LTD (GB)

( * ) Notice: Subject to any disclaimer, the term of this patent is extended or adjusted under 35 U.S.C. 154(b) by 510 days.

(21) Appl. No.: 14/480,447

(22) Filed: Sep. 8, 2014

(65) Prior Publication Data

US 2015/0069002 A1 Mar. 12, 2015

(30) Foreign Application Priority Data

Sep. 9, 2013 (GB) ..... 1316009.8

(51) Int. Cl.
*B61G 7/10* (2006.01)
*B61G 11/14* (2006.01)
(Continued)

(52) U.S. Cl.
CPC ..... *B61G 7/10* (2013.01); *B61G 7/14* (2013.01); *B61G 11/00* (2013.01); *B61G 11/14* (2013.01); *B61G 11/16* (2013.01)

(58) Field of Classification Search
CPC ..... B61G 11/14; B61G 11/16; B61G 11/00; B61G 7/10; B61G 7/14
(Continued)

(56) References Cited

U.S. PATENT DOCUMENTS 947,348 A 1/1910 Pope
1,062,252 A 5/1913 Pope
(Continued)

FOREIGN PATENT DOCUMENTS

CN 1914080 A 2/2007
CN 101142115 A 3/2008
(Continued)

OTHER PUBLICATIONS

Lorandi, Lorenzo, European Search Report, dated Feb. 17, 2015, 6 pages, European Patent Office, Munich, Germany.
(Continued)

*Primary Examiner* — Zachary L Kuhfuss
(74) *Attorney, Agent, or Firm* — Oathout Law Firm; Mark A. Oathout

(57) ABSTRACT

A coupler pivot. A coupler (10) comprises at least a first gimbal (31; 32) defining a pivot that is secured to a mounting (41) for securing to a frame member of a vehicle, the pivot also being secured to a buffer column (39) part of which protrudes on an opposite side of the pivot to the mounting (41) such that the buffer column (39) is moveable relative to the mounting (41) with at least two degrees of freedom. The buffer column (39) defines a free (42) end that is remote from the mounting (41) and that is securable to a further member. The buffer column (39) also includes both a reversible buffer that attenuates buff and draft forces acting between the free end (42) and the mounting (41) and also a non-reversible buffer that attenuates buff forces acting between the free end (42) and the mounting (41) and attaining or exceeding a predetermined energy threshold, the reversible and non-reversible buffers overlapping over at least part of their lengths in the buffer column (39) which in turn overlaps at least one of the pivots.

14 Claims, 5 Drawing Sheets

(51) Int. Cl.
*B61G 11/16* (2006.01)
*B61G 7/14* (2006.01)
*B61G 11/00* (2006.01)

(58) Field of Classification Search
USPC ..... 213/1 A
See application file for complete search history.

(56) References Cited

U.S. PATENT DOCUMENTS

| | | | | |
|---|---|---|---|---|
| 1,178,931 | A | 4/1916 | Krakau | |
| 4,232,793 | A * | 11/1980 | Hallam | B61G 3/00 213/20 |
| 2007/0107623 | A1 | 5/2007 | Radewagen | |
| 2012/0031299 | A1 * | 2/2012 | Kontetzki | B60R 19/34 105/392.5 |
| 2012/0199545 | A1 * | 8/2012 | Peckham | B61G 11/16 213/65 |
| 2013/0126458 | A1 | 5/2013 | Ewerding | |

FOREIGN PATENT DOCUMENTS

| | | | |
|---|---|---|---|
| CN | 201573671 | | 9/2010 |
| CN | 202541572 | | 11/2012 |
| CN | 202669839 | U | 1/2013 |
| CN | 103068664 | A | 4/2013 |
| DE | 44 45 182 | | 12/1995 |
| DE | 103 55 640 | | 11/2004 |
| EP | 1 990 251 | | 11/2008 |
| EP | 2 072 370 | | 6/2009 |
| GB | 2173755 | | 10/1986 |
| WO | 2013/134920 | | 9/2013 |

OTHER PUBLICATIONS

Churchill, Brendan, Combined Search and Examination Report under Sections 17 and 18(3), dated May 2, 2014, 8 pages, UK Intellectual Property Office, South Wales, UK.

Lui Chengya (刘呈雅), First Notice of Opinion, CPME1443999, Aug. 18, 2017, pp. 1-7, State Intellectual Property Office of the P.R.C, Beijing, China.

Kashan, Eid, Professional English Language Translation (Professional English Translation version of CN Office Action & its machine English translation submitted in IDS2.pdf on Nov. 16, 2017), Oct. 19, 2017, pp. 1-7, Birmingham, UK.

* cited by examiner

COUPLER

The invention relates to a coupler.

A coupler is used when connecting two vehicles together to form a train. Known coupler designs include a bracket that is securable to the frame normally present at an end of a rail vehicle such as a railcar or tram car; and protruding therefrom a gimbal arrangement. A coupler element protrudes from the gimbal arrangement for coupling to an adjacent vehicle in the train.

The gimbal arrangement typically consists of two gimbals that are moveably secured one to another such that their pivot axes are mutually orthogonal, with one pivot axis extending horizontally and the other extending vertically. One of the gimbals is fixed to the bracket and the other has the coupler element protruding from it in a direction extending away from the bracket and the frame member of the vehicle to which the bracket is secured.

As a result the coupler element exhibits two degrees of freedom relative to the bracket. In turn this means that, as a result of the orientations of the pivot axes, a coupler can accommodate relative movement between the vehicle cars in both horizontal and vertical directions.

Thus the coupler is capable of accommodating up to the limits of movement of the gimbals side-to-side relative movement, between adjacent cars, caused by rail track curves in a horizontal plane; and also vertical relative movement caused by undulations and inclines in the track. Couplers of this type therefore are often used in tram and light rail systems, in which owing to the undulations of the (typically) urban locations in which they are installed it is not always possible to lay the track without creating inclines.

It is in addition to a coupling function as described necessary to provide a buffer between two adjacent rail vehicles. The frames and other parts of the vehicles are essentially rigid, and this means that impulses can propagate from one car to the next. In the absence of buffers between cars the transmission of even relatively small impulses can give rise to damage to the cars or coupling equipment joining them together, and also means that the effects of impulses as experienced by passengers in the cars are not attenuated. This in turn means that the interiors of the cars would be noisy, and the passengers would repeatedly suffer jolts as the vehicles move, if buffer elements were not provided.

It therefore is known to provide a buffer element as a component of a coupler.

In some designs the buffer element is fixed in the coupler element so as to form part of it. This arrangement while permitting the incorporation of a bi-directional energy absorber that attenuates both buff and draft forces significantly lengthens the coupler element compared to an arrangement from which the energy absorber is absent.

This is a significant disadvantage partly because of a general desire for compactness in engineering components used in transport machinery; and also because the use of a relatively long coupler element means that compressive forces acting in the element when attenuation of buff forces occurs can be mis-aligned with the longitudinal axis of the coupler. This is especially likely when the coupler is accommodating curves and track undulations as described above.

At such time the risk of damage through the application of forces not acting exactly longitudinally in the coupler increases.

Furthermore there is a heightened requirement for compactness in couplers for tram and light rail vehicles, as these vehicles tend generally to be smaller than train cars intended to travel long distances.

As a solution to the disadvantage of length associated with the connection of a buffer in series in the coupler element it is known to combine a number of elastomeric elements into the region of the coupler that lies in the space between the gimbals.

Such coupler are sometimes referred to as being of the "EFG" type, from the German term Elastomer-Federgelenks (which approximately translates into English as "Elastomer Spring Pivot").

One known design of EFG 10 is shown in vertically sectioned view in FIGS. 1 and 2 and has a coupler element 11 including an end 12 that penetrates the region 13 between top and bottom sides of a gimbal 14 of a coupler including a mounting bracket 16. The coupler element end 12 is formed with a plurality of harpoon-like projections 17 that extend at right angles to the elongate direction of the coupler element.

The projections 17 penetrate and are anchored in an elastomeric, resiliently deformable sleeve 18 that surrounds the coupler element end 11 and occupies the space between it and the surrounding sleeve 19 of the gimbal 14. The external surface of the elastomeric sleeve 18 and the inner wall of the gimbal sleeve 19 are formed with complementary protrusions and recesses, as illustrated, whereby the sleeve 18 is anchored against longitudinal tension forces that otherwise tend to pull it out of the sleeve 19.

The gimbal 14 is arranged so that its pivot axis is vertical. The coupler element 11 is secured, via the elastomeric sleeve 18, to the inner sleeve 19 of the gimbal 14. Thus the EFG 10 is able to accommodate track curves by reason of the coupler element 11 and inner sleeve 19 together rotating about the vertical axis of the gimbal 14, relative to an outer sleeve 21 of the gimbal.

The connection together of the end 12 of element 11 and the elastomeric sleeve 18, together with the anchoring of the latter relative to the inner sleeve 19 of the gimbal 14, accommodates buff and draft forces up to a limit determined by the strength of the elastomeric sleeve 18. The sleeve 18 attenuates such forces by distorting longitudinally as shown in FIG. 1, in which the coupler element 11 is shown withdrawn out of the region 13 by a distance related to the elasticity, and the elastic limit, of the sleeve 18.

Vertical pivoting of the EFG is accommodated by reason of the fact that the element end 12 and projections 17 are smaller in diameter than the interior of inner gimbal sleeve 19, with the result that there is room for the element end 11 to "float" in the interior of the gimbal 14 with the resilient deformability of the elastomeric sleeve 18 resisting the tendency of the element end 12 to move in this way. As a result relative up-and-down movements of the coupled vehicles are damped.

The EFG also includes a further resiliently deformable (elastomeric) member 22 that supports the coupler element from underneath as illustrated. This too deforms in the event of movement of the coupler element 11 relative to the bracket 16, providing additional force attenuation and stability.

In FIG. 1 the EFG 10 is illustrated in the condition it adopts when resisting a draft force. Thus in FIG. 1 the elastomeric sleeve 18 and the further elastomeric member 22 are shown distorted in a direction parallel to the elongate axis of the coupler element 11, as these components are apt to do when draft forces are encountered.

In the event of the EFG resisting buff forces a reverse situation arises, with the elastomeric parts 18, 22 distorted parallel to the axis of the coupler element 11 in a direction towards the bracket 16. This situation is partially illustrated in FIG. 2, but in this figure the EFG also is accommodating a vertical movement between adjacent vehicles with the result that vertical distortion of the elastomeric parts is also apparent.

Although the EFG design shown in FIGS. 1 and 2 is relatively cheap to make, and requires the presence of only one vertical pivot, it nonetheless suffers from numerous disadvantages.

Firstly the elastomeric elements 18, 22 are prone to wear and failure, often without any visible sign that failure is imminent. The elastomeric sleeve 18 in particular is difficult to assess from the standpoint of its integrity since it is tightly received in, and obscured by, the sleeve 19 of gimbal 14.

Secondly although the arrangement of FIGS. 1 and 2 can attenuate buff and draft forces by reason of the element end 12 being able to float in both fore and aft directions inside gimbal sleeve 19, any high-frequency longitudinal force experienced by the EFG 10 cannot be readily accommodated.

High-frequency forces experienced by rail vehicle couplers usually are compressive and result from relatively high-speed impacts as may occur in accident situations. The stiffness of the elastomeric elements 18, 22 is such that the EFG transmits high-frequency forces instead of attenuating them. Thus in an accident situation the EFG could be thought of as not so much an energy absorption device as an energy transmission device that for this reason could potentially do serious damage to the vehicles it is intended to couple together.

In view of this it is necessary to provide in conjunction with an EFG of the kind shown in FIGS. 1 and 2 a device that is capable of attenuating the high-frequency forces when they arise.

Typically such a device is a deforming tube assembly. This is an arrangement of inner and outer hollow, cylindrical tubes the inner one of which is of smaller diameter than part of the length of the outer tube. The smaller diameter inner tube is partially received inside the outer tube, abutting a taper that is the transition between a relatively large diameter part of the outer tube that can accommodate the inner tube; and a relatively narrow diameter part the diameter of which is less than the external diameter of the inner tube. Part of the inner tube protrudes from the outer tube and defines an end of the deforming tube assembly. The opposite end of the assembly is defined by the free end of the outer tube.

The outer tube is made from a plastically deformable material such as a steel. When the deforming tube assembly is subjected to a high-value compressive force acting between its ends the inner tube is driven further into the outer tube as the assembly becomes compressed. This causes the inserted end of the inner tube to iron the wall of the outer tube and make the taper travel along the assembly towards the free end of the outer tube. This causes dissipation of the energy through plastic deformation of the material of the outer tube. The inner tube is sufficiently hard as not to deform during this process.

Deforming tube assemblies are well known in the rail buffer art, and as noted can be used in conjunction with an EFG of the kind outlined above. When so used however they give rise to further disadvantages.

The first of these is that the deforming tube assemblies can be somewhat long, because a significant length of deformable outer tube is required to attenuate railway impact forces. If such a tube is assembled in series with an EFG this can give rise to a composite buffer the overall length of which is unacceptable.

Rail vehicle designers therefore sometimes accommodate the length of the deforming tube assembly in a long recess in the frame of the rail vehicle extending under the vehicle floor but this is problematic as well. This is not least because a need to occupy space inside the rail vehicle reduces the freedom of the vehicle designer to include additional equipment such as electronic systems that nowadays are commonplace in rail vehicles. There is little such space in tram and light rail cars.

Furthermore the positioning of a deforming tube assembly inside the vehicle in some cases may require modification of the design of the vehicle frame in order to provide a reaction surface for the free end of the outer tube; and moreover it is difficult to inspect or test a deforming tube assembly that is obscured from view in this way.

Yet a further drawback of a deforming tube assembly as used in conjunction with an EFG relates to the inclusion of shear bolts. Usually a plurality of such bolts is provided, arrayed around the circumference of the outer tube. The shear bolts allow the coupler to drop away after the deformation tube has fully stroked, so preventing car body damage and allowing anti-climbers, which are normally present at rail car ends as is known to the person of skill in the art, to engage.

In some coupler designs, a plurality of shear bolts are provided within a coupler element or connecting the bracket to the rail car frame, the purpose being to limit the maximum force that the rail car frame experiences from the force transmitted through the coupler. Owing to manufacturing variations however and the fact that the shear bolts might not all experience the same environmental factors the bolts may not in fact shear simultaneously when an impact arises. The shear bolts are also expensive to manufacture and may not function correctly if they have been tightened unevenly.

In addition to the foregoing CN 201573671 discloses a buffer element within the pivot. The arrangement includes a mounting plate that is intended for attachment to the rear face of e.g. a frame member at the front of a rail vehicle, with the coupler element protruding forwardly via an aperture in the frame member.

The invention seeks to solve or at least ameliorate one or more problems of prior art buffer arrangements.

According to the invention in a broad aspect there is provided a coupler comprising at least a first gimbal defining a pivot that is secured to a mounting for securing to a frame member of a vehicle, the pivot also being secured to a buffer column that protrudes on an opposite side of the pivot to the mounting such that the buffer column is moveable relative to the mounting with at least two degrees of freedom, the buffer column defining a free end that is remote from the mounting and that is securable to a further member and the buffer column including both a reversible buffer that attenuates buff and draft forces acting between the free end and the mounting and also a non-reversible buffer that attenuates buff forces acting between the free end and the mounting and attaining or exceeding a predetermined energy threshold, the reversible and non-reversible buffers overlapping over at least part of their lengths in the buffer column that also overlaps one or more of the pivots.

Such an arrangement provides the combined, advantageous effects of a pivoting coupling, a reversible buffer and a non-reversible (e.g. deforming tube) buffer in a compact arrangement, the compactness deriving from the feature of providing overlapping buffer and pivot parts as defined.

Furthermore all parts of the coupler of the invention may be arranged to lie essentially externally of any vehicle on which they are mounted for use, thereby avoiding the need to use up space under the vehicle floor and also thereby presenting all the parts in a location at which they are easy to inspect and service.

In some vehicles notwithstanding the compactness of the coupler of the invention, following a severe impact part of the length of the coupler may lie "inboard" of the vehicle frame extending into a recess or through an aperture. The compact nature of the coupler of the invention however means that even in such circumstances less internal space needs to be made available than in prior art designs in which a substantial length of the coupler lies within the vehicle frame, thereby improving the ability of the vehicle designer to include additional components even when it is necessary to use up some of the space behind the frame member.

In addition the coupler pivot of the invention beneficially gives rise to an arrangement in which it is not necessary to use shear bolts and in which it is immediately visually apparent (through inspection of e.g. a tell-tale) whether the coupler pivot has been subjected to a sufficiently severe impact as to initiate plastic deformation of the deforming tube assembly.

The terms "reversible" and "non-reversible" as applied herein to buffers refer respectively on the one hand to buffers that return to an original or intermediate condition following stroking; and on the other to buffers that are permanently, and hence non-reversibly, altered by being stroked. Such terms will be familiar to the person of skill in the art.

Preferably the pivot additionally includes a second gimbal and the axes of the gimbals are mutually orthogonal. This provides for a two degree-of-freedom device, as is commonly called for in coupler pivots.

Advantageously the non-reversible buffer encircles the reversible buffer. This provides the partially overlapping arrangement of the reversible and non-reversible buffers as defined above.

In a particularly preferred embodiment of the invention the non-reversible buffer includes a plastically deformable, hollow tube defined by at least one tube wall having formed therein a tube taper that tapers in a direction towards the mounting; and an impact member defining a deforming taper of generally complementary shape to the tube taper, the deforming taper engaging the tube taper and the impact member being secured to the remainder of the buffer column such that on a high-energy buff force acting between the free end and the mounting that attains or exceeds the energy threshold the deforming taper plastically deforms the tube by causing the tube taper to travel towards the mounting and thereby attenuate the energy of the high-energy buff force.

Thus in an advantageously compact version of the invention there are provided components amounting to a deforming tube assembly located so as to encircle a reversible buffer. The two buffers in effect therefore are connected in parallel at one end to the vehicle to which the coupler pivot is mounted and at the other end to a further vehicle coupled via the free end of the coupler pivot. As a result both the reversible and non-reversible buffers are subjected to longitudinally acting compression forces; and the nature of the forces determines whether the reversible buffer activates alone or whether the non-reversible buffer also operates to attenuate impact energy.

Further preferably the tube taper and the deforming taper are annular and encircle the reversible buffer. This means that the point in the axis along the length of the coupler at which the reversible and non-reversible buffers attenuate forces is essentially the same. This in turn assists in providing an arrangement in which there is a low likelihood of forces acting in an offset manner as may happen in the serially added deforming tube assembly described above.

In a preferred embodiment of the invention the reversible buffer includes two or more relatively moveable buff attenuation members such that the reversible buffer is moveable between an intermediate and a compressed configuration. In the compressed configuration the reversible buffer is capable of contacting the impact member to cause plastic deformation of the hollow tube.

Thus the reversible buffer may be configured as an essentially conventional buffer capsule or assembly in which a piston is sealingly slideably received inside the hollow interior of an elongate tube and forces a fluid such as an oil through a series of valves and orifices in order to dissipate energy tending to compress the buffer.

Alternatively the reversible buffer may be or include a compressible fluid which is compressed between a piston and a tube; or a ring spring, in which elastomeric or metallic elements are resiliently deformed on compression of the buffer.

Regardless of the exact design of the buffer it is advantageous that the buffer is capable of contacting the impact member when fully stroked in the compression direction. This means that inherently the apparatus of the invention includes a means that discriminates between relatively low energy impacts, that solely cause (reversible) compression of the reversible buffer; and higher energy impacts that cause plastic deformation of the non-reversible buffer following contact of the reversible buffer with the impact member.

In one particularly advantageous embodiment of the invention the mounting includes formed therein a recess or aperture; and a part of the hollow tube protrudes via the recess or aperture.

This arrangement permits part of the hollow tube to lie on the opposite side of the pivot to that on which the major part of the buffer column extends. This gives rise to a relatively short structure in which all the operative parts of the buffer column are accommodated; and in which the pivot axis of the pivot may be arranged to lie at a favourable position relative to the mounting. In particular the positioning of some of the buffer column "beyond" the pivot (measured in the direction towards the vehicle on which the coupler pivot is mounted) means that the likelihood of high-frequency forces acting off-centre relative to the longitudinal axis of the coupler pivot is reduced (because most of the motion giving rise to plastic deformation of the reversible buffer elements takes place close to the axis of the pivot).

The dimensions of the recess or aperture preferably are such as to accommodate the tube taper with clearance on plastic deformation of the hollow tube. The part of the hollow tube that lies relatively proximate the pivot enlarges in diameter as the taper travels towards the mounting on activation of the non-reversible buffer. The feature of the recess accommodating the hollow tube after it has been deformed (i.e. enlarged) means that even following a severe impact that activates the non-reversible buffer a pivoting function continues to be available. This in turn means that a train of coupled vehicles can continue to articulate following a severe impact. This in turn assists in reducing the risk of derailments.

As noted one preferred form of the buff attenuation members includes a compressible fluid spring having a piston lying within a buffer tube that is sealingly moveable on the exterior of the piston so as to define a chamber that contains a compressible fluid, the arrangement being such that on movement of the reversible buffer from the intermediate to the compressed configuration the compressible fluid becomes compressed in the chamber thereby attenuating buff forces of a relatively low energy value.

Preferably the non-reversible buffer includes or is operatively connected to a tell-tale that provides a visible indication of whether the non-reversible buffer has been activated.

Conveniently the reversible buffer includes two or more relatively moveable draft attenuation members such that the reversible buffer is moveable between an intermediate and an extended configuration, the reversible buffer including between the draft attenuation members one or more resiliently deformable members that attenuate draft forces. Thus the draft force attenuation part of the coupler pivot can optionally be configured in a manner similar to that of part of the EFG arrangement described above, or as a ring spring (the nature of which will be known to the person of skill in the art).

The free end of the coupler of the invention optionally may include one or more coupler formations for securing the coupler to a said further member. As a non-limiting example the formations could define a muff groove, the nature of which is known to the person of skill in the art, that can be rigidly secured to a muff coupler that in turn connects to a similar groove formed in a protuberance from an adjacent vehicle requiring coupling. Other forms of coupler formation however are possible within the scope of the invention.

The invention is also considered to reside in a vehicle including secured thereto the mounting of a coupler according to the invention as defined herein.

Preferably such a vehicle includes formed therein a recess for accommodating with clearance the part of the hollow tube that protrudes via the recess or aperture of the mounting, when this feature is present.

Rail vehicles typically include at either end a rigid beam that forms part of the vehicle frame. The recess may without detriment to the integrity of the vehicle frame design be formed in this beam in order to accommodate the motion of the protruding part of the hollow tube.

BRIEF DESCRIPTION OF THE DRAWINGS

There now follows a description of preferred embodiments of the invention, with reference being made to the accompanying drawings in which.

DETAILED DESCRIPTION

Figure 1:
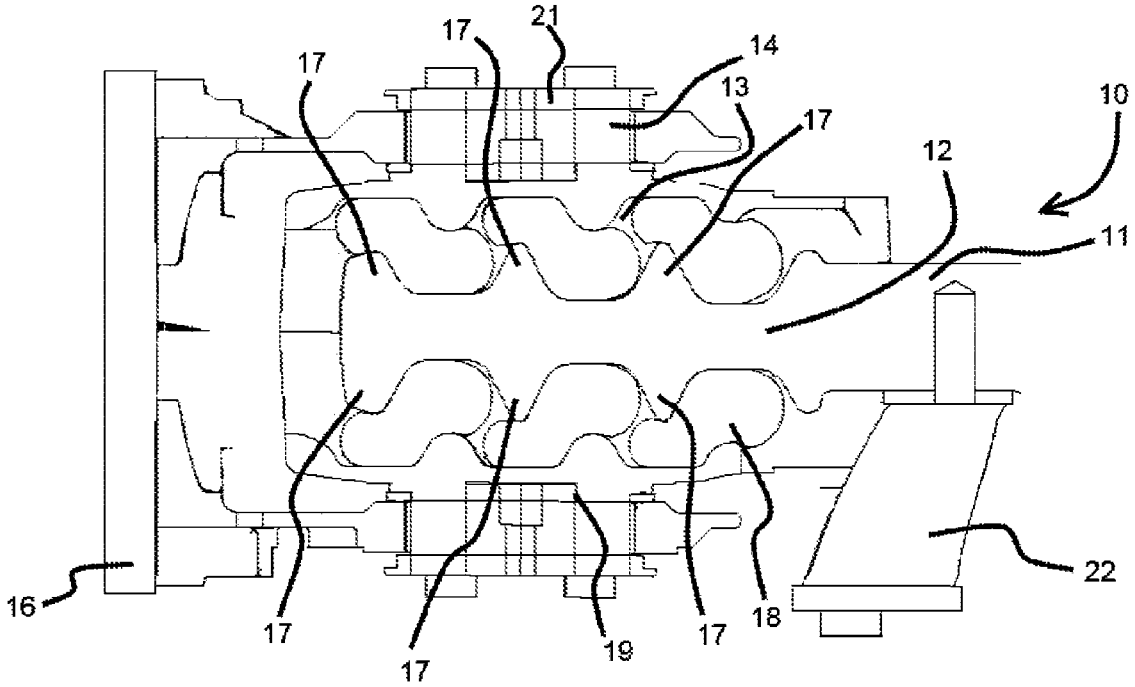
(Prior Art) Figure 1
FIG. 1 is a cross-sectional view of a prior art EFG coupler pivot, shown in the condition resisting a draft force tending to pull a coupler element out of the interior of a gimbal.
Figure 2:
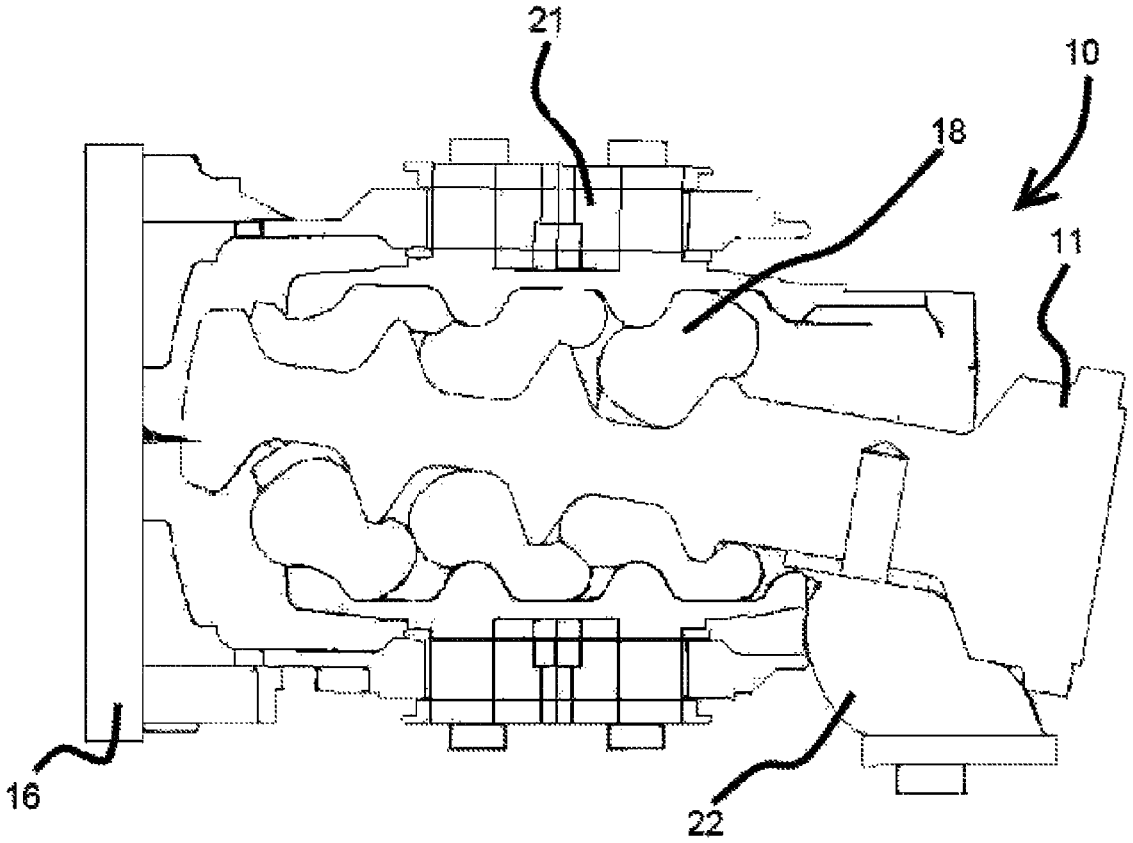
(Prior Art) Figure 2
FIG. 2 shows the FIG. 1 EFG when absorbing the energy of a draft force and a vertical relative movement between coupled vehicles.
Figure 3:
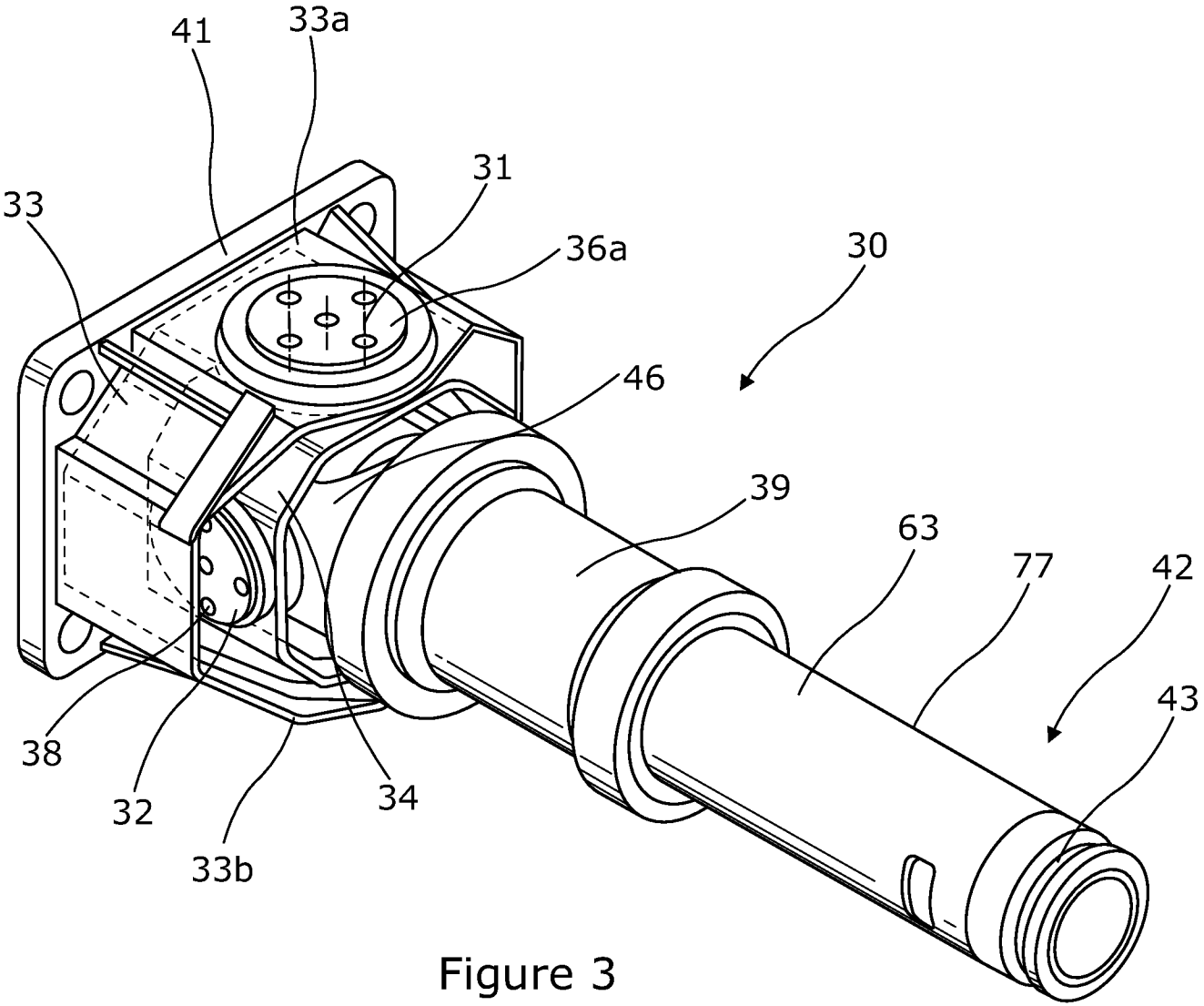
FIG. 3 is a perspective view of a coupler pivot according to the invention.
Figure 4:
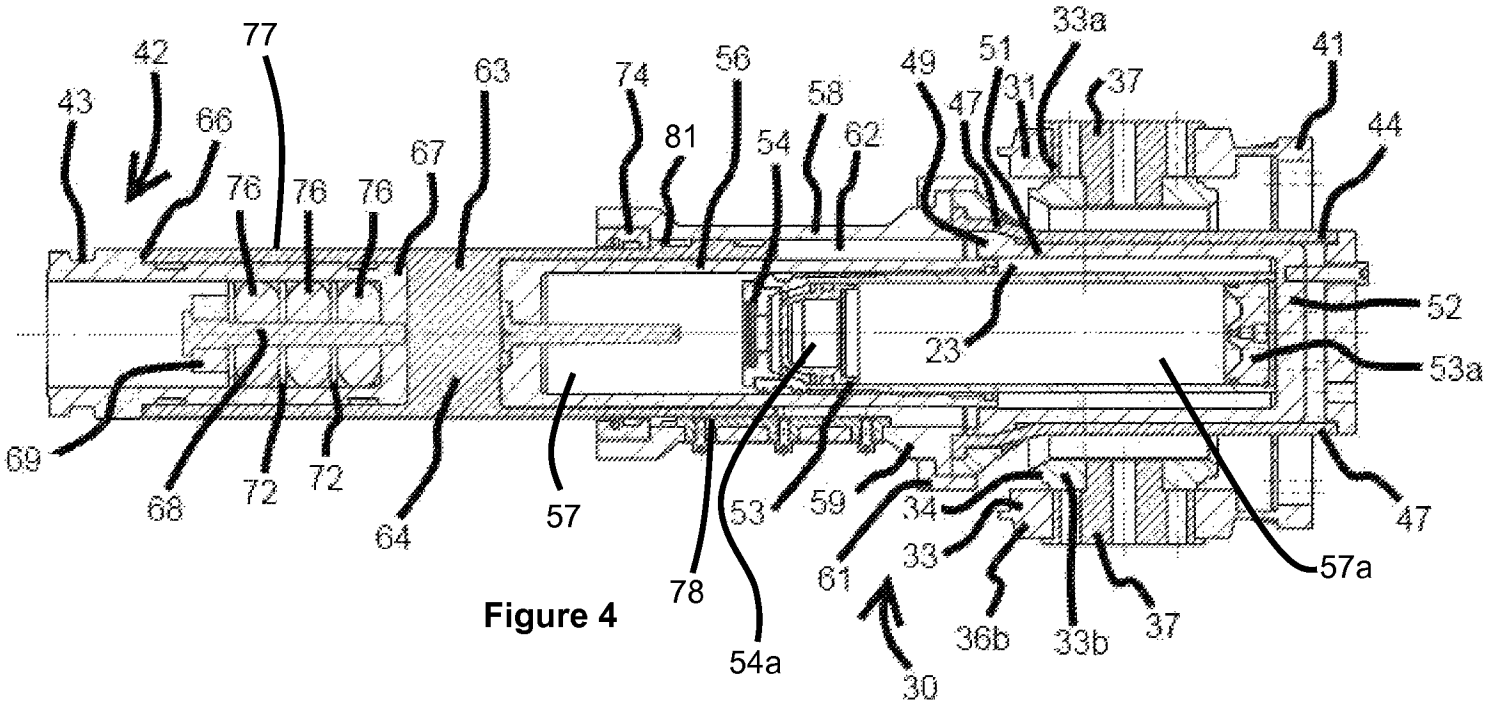
FIG. 4 is a vertically cross-sectioned view of the FIG. 3 coupler pivot.
Figure 5:
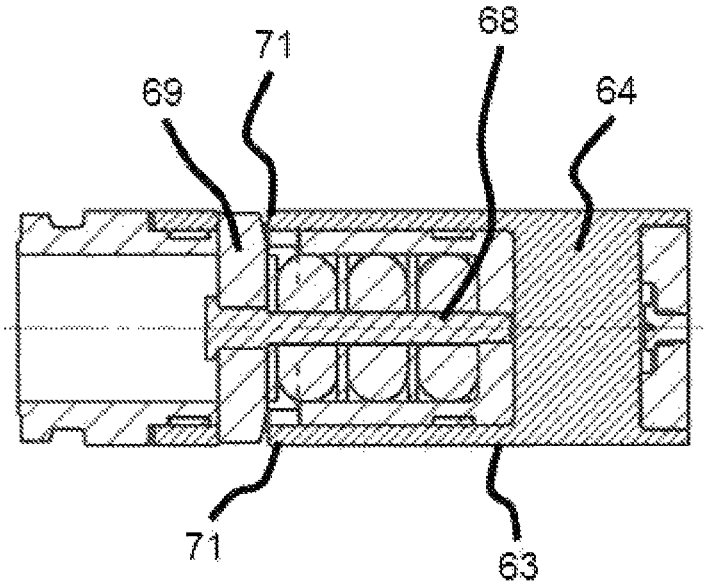
FIG. 5 is a horizontally cross-sectioned view of the free end of the coupler pivot of FIGS. 3 and 4.

Referring to FIGS. 3 to 5 a coupler 30 comprises a pair of gimbals 31, 32 that define a corresponding pair of pivots the pivot axes of which intersect at ninety degrees to one another. The coupler is intended for coupling together in the manner described in general herein an adjacent pair of vehicles that normally would be rail-mounted.

The pivot axis defined by gimbal 31 is in the embodiment shown vertical and that of gimbal 32 horizontal in normal use of the coupler pivot 30. However in other embodiments of the invention it need not necessarily be the case that the axes of the gimbals are so orientated, or indeed intersect orthogonally as stated.

Furthermore in simple versions of the invention only a single gimbal needs to be provided, that accommodates relative movements between adjacent vehicles in a horizontal plane and therefore provides for a single degree of freedom coupler pivot. In most practical embodiments of the invention however the two degree of freedom version, having mutually orthogonally acting gimbals as shown, is preferred.

Each gimbal 31, 32 comprises a respective cuboidal frame 33, 34 that preferably is e.g. a steel casting or is fabricated. The cuboidal frame of horizontal axis gimbal 32 is smaller than that of vertical axis gimbal 31 whereby as illustrated frame 34 fits inside frame 33.

On each of two parallel walls 33*a*, 33*b* frame 33 supports a respective journal bearing 36*a*, 36*b* of which only one, 36*a*, is visible in FIG. 3.

Each journal bearing 36*a*, 36*b* includes a cylindrical member 37 secured to and extending through it such that the cylindrical member is rotatably supported relative to the frame 33.

Each cylindrical member 37 is secured to the exterior of cuboidal frame 34 with the result that the latter is rotatably supported relative to frame 33, such that the axis of rotation is vertical.

Similar journal bearing 38 arrangements are provided in cuboidal frame 34, including cylindrical members that extend horizontally to connect to a curved bracket 46 that extends forwardly to secure rigidly to a buffer column 39 part of the length of which is received inside cuboidal frame 34. In the embodiment shown the curved bracket 46 is perforated by the buffer column that is of circular cross-section. The buffer column 39 therefore may be made as a tight (e.g. press) fit inside the perforation in the curved bracket 46, which as shown in FIG. 3 extends to attach to the cylindrical members on each side of gimbal 32.

As a result buffer column 39 is pivotably mounted relative to frame 34 by way of a horizontal pivot axis. This together with the pivoting mounting of the frame 34 relative to frame 33 means that the buffer column 39 is pivotably secured relative to cuboidal frame 34 with two degrees of freedom, and with the axes of pivoting intersecting orthogonally as described.

The frames 33, 34, journal bearings 36, 38 and related parts amount to a pair of gimbals defining a pivot.

Cuboidal frame 33 is secured to a mounting in the form of a bracket plate 41. This is a rigid, typically metal, plate that is perforated for rigid securing to the aforementioned beam forming part of the frame of a vehicle. It follows that the buffer column 39 is pivotably supported with two degrees of freedom relative to the mounting constituted by bracket plate 41, and hence with two degrees of freedom relative to any vehicle to which the coupler is in use secured.

At its end remote from bracket plate 41 buffer column 39 defines an end 42 that is referred to herein as the "free end" of the buffer column (this end being free when the column is not connected to any further component).

In the illustrated embodiment, the free end 42 includes a groove 43 that allows its securing, for example by way of a per se known muff connector, to a further component such as an element of the coupler of an adjacent vehicle. Groove 43 therefore preferably is constituted as a muff groove the design of which would be familiar to the person of skill in the art. Other connector arrangements, as would be known to the person skilled in the art, however may be provided at free end 42.

As described in more detail below the buffer column 39 includes inside its interior both a reversible buffer that attenuates buff and draft forces acting between the free end and the mounting and also a non-reversible buffer that attenuates buff forces acting between the free end and the mounting and attaining or exceeding a predetermined energy threshold.

The reversible buffer and the non-reversible buffer overlap over part of the length of the buffer column 39 which in turn overlaps one or more of the pivots 31, 32. The means by which this is achieved are explained below. As noted a significant advantage of this aspect of the embodiment is that it permits a multi-function buffer to be accommodated without excessively increasing the length of the coupler as in prior art arrangements.

As best illustrated in FIG. 4, the non-reversible buffer is constituted by a plastically deformable (typically but not necessarily steel) elongate, hollow essentially cylindrical tube 44 that lies principally within cuboidal frame 34.

Hollow tube 44 is of constant diameter over most of its length and encircles further parts of the buffer column 39, described below, lying within cuboidal frame 34. A portion of the hollow tube 44 however protrudes outwardly form the cuboidal frame 34 on the same side of the frame as the free end 42 of the buffer column.

In the vicinity of this part the hollow tube 44 enlarges in diameter to define an annular taper 47 in the material of its cylindrical wall 48. As shown in FIG. 4 this taper 47 tapers in a direction towards the bracket plate 41.

An impact member in the form of an annular wedge 49 tapering in the same direction and with approximately the same shape as the inside of taper 47 is received in the hollow interior of tube 44. Wedge 49 extends towards bracket plate 41 to define a plunger 51 terminating in a closed end 52. Closed end 52 acts as a reaction surface for reversible buffer parts described below.

The reversible buffer parts are constituted by a cylindrical piston member 53 that at one end 53*a* is sealingly secured to the interior of closed end 52 of hollow tube 44 and at the opposite end terminates in a piston end member 54.

A separator 54*a* is sealingly slideably provided on the inner surface of piston member 53 such that a fluid chamber 57*a* is defined between the piston member 53, separator member 54*a* and closed end 53*a*. A compressible gas is captured in the fluid chamber 57*a* such that the piston member 53, separator member 54*a* and closed-ended tube 53*a* define a resiliently deformable gas spring that on compression longitudinally resiles by reason of the energy thus imparted to the compressible fluid in chamber 57*a*.

Sealingly slideably received on the external surface of piston member 53 is a closed-ended, hollow tube 56 that is open at an end opposite its closed end and that partially overlaps along the length of the piston member 53.

Closed-ended tube 56 is closed at its end remote from piston member 53 with the result that a fluid chamber 57 is defined between the piston end 54 and the interior walls of closed-ended tube 56.

A fluid such as oil is captured in the fluid chamber 57 such that on compression of the buffer the fluid becomes forced through a series of valves and orifices (not shown) in piston end 54.

Fluid flowing through the orifice and valves in piston end 54 at such a time enters the space between piston end 54 and the separator 54*a*. To accommodate the oil the separator 54*a* moves in the direction of closed end 53*a* resulting in a reduction of the volume of chamber 57*a* and compression of the gas in chamber 57*a*.

The gas spring tends to cause the coupler pivot to adopt the configuration shown in FIGS. 3 and 4, which position is referred to herein as an intermediate position.

The axis of the resulting reversible energy absorber coincides with the operative axis of a non-reversible buffer defined by the taper 47 and impact member (annular wedge) 49.

As is apparent from the lengths of the piston member 53 and closed-ended tube 56 the reversible buffer overlaps over a significant part of its length with the non-reversible buffer, thereby leading to a compact arrangement. The non-reversible buffer moreover encircles the reversible one.

Closed-ended tube 56 lies within a hollow, cylindrical shroud 58 that extends parallel to the buffer column and terminates at its end nearest bracket plate 41 in a flange 59 that engages the end of hollow tube 44. A clamp ring 61 encircles the flange 59 and binds the shroud and the hollow tube together.

By reason of their respective diameters an annular space 62 exists between the exterior of closed-ended tube 56 and the interior of shroud 58. A circular cross-section column member 63 is hollow over the major part of its length and encircles the closed-ended tube in the annular space 62. Column member 63 is slideable in the space 62.

Part-way along the length of its interior column member 63 is divided in two by a mounting disc 64. The remainder of the length of column member 63 is again hollow until it terminates at an open end 66.

Open end is plugged by a draft attenuator cup 67 that is inserted into the interior of column member 63 on the opposite side of the mounting disc 64 to that of the reversible buffer and the taper 47 and related components. The muff groove 43 is formed in an external part of this component that as shown protrudes outwardly from the open end of the column member 63.

A spring retainer rod 68 extends inside draft attenuator cup 67 and is secured at one end to it. At its opposite end retainer rod 68 pierces a transverse member 69 that extends through transversely formed perforations 71 in the wall of column member 63 to either side of the retainer rod 68.

Trapped between the transverse member 69 and the mounting disc 64, and perforated by the retainer rod 68 is a stack of essentially abutting annular spring elements 76 that are elastomeric and are spaced from one another by washers 72 the functions of which are known in the spring art.

The reversible buffer operates when forces exerted between the ends of the coupler pivot are relatively small. Buff forces cause compression of the coupler pivot between its ends with the result that forces experienced at the muff ring 43 are transmitted via the draft attenuator cup to the mounting disc 64 and thence to the closed end of closed ended tube 56.

This causes the closed-ended tube 56 to move in the general direction of the bracket plate, with the wall of the closed ended tube 56 sliding in a further annular space 23 existing between the interior of the plunger 51 and the exterior of the piston member 53.

During this process the oil in chamber 57 flows through the orifices and valves in piston end 54 and the gas in the chamber 57*a* becomes compressed and thereby energised. When the buff force is released the resulting stored energy causes expansion of the gas and thereby drives the closed-ended tube back to the intermediate position shown in FIGS. 3 and 4.

If a relatively low energy draft force is experienced this induces tension in the coupler pivot 10. This tends to draw the column member 63 off the end of the closed-ended tube 56, but this tendency is resisted because the column member 63 is retained inside the shroud 58 by an annular collar 74 that is retained in the open end of the shroud 58. The collar 74 is engaged on outward stroking of the column member 63 by an annular ridge 81 formed on the external surface of column member 63.

A key 78 engages with a groove in the annular ridge 81 of column member 63 which together with the transversely formed perforations 71 engaging in the wall of column member 63 and attenuator cup 67 prevent the muff ring 43 rotating around the axis of the buffer element relative to the mounting 41.

Following such engagement between the collar 74 and the ridge 81 any further tensile force acts via the muff ring 43 and attenuator cup 67 and is transferred to the transverse member 69 and thence to the column member 63. This causes compression of the spring elements between the end of attenuator cup 67 and the transverse member 69. Since the spring elements are resiliently deformable this action attenuates the energy of the draft event until the stroke is exhausted by the extent of the transversely formed perforations 71 in the wall of column member 63.

Once the event has terminated the stored energy in the spring elements causes them to expand, in turn causing the cup to be returned to the position shown in FIG. 4.

In the event of a significant impact, as may arise in an accident situation, high-frequency compression energy is imparted to the coupler pivot with the result that the reversible buffer becomes fully stroked. As a consequence the open end of column member 63 nearest to bracket plate 41 engages the rear face of annular wedge 49 and drives its taper further into engagement with the taper 47 in the wall of the hollow tube 44.

Assuming the impact is sufficiently energetic this causes the taper 47 to travel along the wall towards the bracket plate 41, permanently deforming the hollow tube 44 in an energy attenuating manner. The high impact force experienced in an accident therefore is safely and predictably absorbed.

The dimensions of the cuboidal frame 34 are such that even following such deformation of the hollow tube 44 (which results in the enlarged diameter part of it moving closer to the bracket plate 41) there remains sufficient clearance between the hollow tube and the cuboidal frame 34 as to allow the gimbals 31, 32 to continue to function. Thus the risk of a derailment that would be caused by locking up of the coupler pivot in an accident is likely to be avoided.

As is signified schematically the embodiment visible in FIG. 4 part of the length of the hollow tube protrudes through an aperture in the bracket plate 41. This also allows for overall compactness of the coupler, with the pivot axes overlapping the coupler element. This reduces the turning moments that might arise in a very long device (such as those of the prior art) in which a compressive force acts off-centre. Therefore the chances of the reversible buffer part of the coupler pivot locking up in use are reduced.

As is apparent from FIG. 3 a tell-tale 77 is provided on the column member 63. This is a visual indicator of whether the non-reversible buffer has been stroked. The tell-tale 77 may take a range of forms that are known to the person of skill in the art.

Following use of the buffer 30 it is therefore immediately apparent whether the hollow tube has been plastically deformed as described above. The safety of the coupler therefore can be readily assessed.

Yet a further benefit of the arrangement of the invention is that the presence of the deformable hollow tube in partial overlap with the parts of the reversible buffer described above means that the latter are likely to be protected against damage in the event of a high-energy impact occurring. Thus following even a severe impact it is likely that only the hollow tube 44 would require replacing before the coupler pivot became useable again.

Various details of the coupler pivot may be changed within the scope of the invention. In particular the relative dimensions of the parts illustrated may be varied, for example to provide couplers of varying sizes and operational duties. Also the type of reversible buffer may be altered, it being necessary only that this part of the coupler fits inside the space available between the plunger 51 and the column member 63.

Yet a further variation within the scope of the invention relates to the number and size of the spring elements 76.

Overall as indicated the invention represents a considerable improvement, at reasonable cost, over the coupler of the prior art.

The listing or discussion of an apparently prior-published document in this specification should not necessarily be taken as an acknowledgement that the document is part of the state of the art or is common general knowledge.

The invention claimed is:

1. A coupler comprising at least a first gimbal defining a pivot that is secured to a mounting for securing to a frame member of a vehicle, wherein the pivot additionally includes a second gimbal and wherein the axes of the gimbals are mutually orthogonal, the pivot also being secured to a buffer column that protrudes on an opposite side of the pivot to the mounting such that the buffer column is moveable relative to the mounting with at least two degrees of freedom, the buffer column defining a free end that is remote from the mounting and that is securable to a further member and the buffer column including both a reversible buffer that attenuates buff and draft forces acting between the free end and the mounting and also a non-reversible buffer that attenuates buff forces acting between the free end and the mounting and attaining or exceeding a predetermined energy threshold, the reversible and non-reversible buffers overlapping over at least part of their lengths in the buffer column that also overlaps at least one of the pivots.

2. A coupler according to claim 1 wherein the non-reversible buffer encircles the reversible buffer.

3. A coupler according to any preceding claim wherein the non-reversible buffer includes a plastically deformable, hollow tube defined by at least one tube wall having formed therein a tube taper that tapers in a direction towards the mounting; and an impact member defining a deforming taper of generally complementary shape to the tube taper, the deforming taper engaging the tube taper and the impact member being secured to the remainder of the buffer column such that on a high-energy buff force acting between the free end and the mounting that attains or exceeds the energy threshold the deforming taper plastically deforms the tube by causing the tube taper to travel towards the mounting and thereby attenuate the energy of the high-energy buff force.

4. A coupler according to claim 3 wherein the tube taper and the deforming taper are annular and encircle the reversible buffer.

5. A coupler according to claim 3 or claim 4 wherein the reversible buffer includes two or more relatively moveable buff attenuation members such that the reversible buffer is moveable between an intermediate and a compressed configuration; and wherein in the compressed configuration the reversible buffer is capable of contacting the impact member to cause plastic deformation of the hollow tube.

6. A coupler according to any of claims 3 to 5 wherein the mounting includes formed therein a recess or aperture; and wherein a part of the hollow tube protrudes via the recess or aperture.

7. A coupler according to claim 6 wherein the dimensions of the recess or aperture are such as to accommodate the tube taper with clearance on plastic deformation of the hollow tube.

8. A coupler according to any one of the claims 5, 6 and 7 wherein the buff attenuation members include a compressible fluid spring having a piston lying within a buffer tube that is sealingly moveable on the interior of the piston so as to define a chamber that contains a compressible fluid, the arrangement being such that on movement of the reversible buffer from the intermediate to the compressed configuration the compressible fluid becomes compressed in the chamber.

9. A coupler according to any one of the claims 5-8 wherein the buff attenuation members include a reversible buffer having buffer capsule or assembly in which a piston is sealingly slideably received inside the hollow interior of an elongate tube and on compression forces a fluid such as an oil through a series of valves and orifices in order to dissipate energy tending to compress the buffer.

10. A coupler according to any preceding claim wherein the non-reversible buffer includes or is operatively connected to a tell-tale that provides a visible indication of whether the non-reversible buffer has been activated.

11. A coupler according to any preceding claim wherein the reversible buffer includes two or more relatively moveable draft attenuation members such that the reversible buffer is moveable between an intermediate and an extended configuration, the reversible buffer including between the draft attenuation members one or more resiliently deformable members that attenuate draft forces.

12. A coupler according to any preceding claim the free end of which includes one or more coupler formations for securing the coupler pivot to a said further member.

13. A vehicle including secured thereto the mounting of a coupler pivot according to any preceding claim.

14. A vehicle according to claim 13 or claim 6 including formed therein a recess for accommodating with clearance the part of the hollow tube that protrudes via the recess or aperture of the mounting.

* * * * *